US009359870B2

(12) United States Patent
Takai et al.

(10) Patent No.: US 9,359,870 B2
(45) Date of Patent: Jun. 7, 2016

(54) METHOD AND SYSTEM FOR RECOVERING OCEAN FLOOR HYDROTHERMAL MINERAL RESOURCES

(71) Applicant: Japan Agency for Marine-Earth Science and Technology, Kanagawa (JP)
(72) Inventors: Ken Takai, Yokosuka (JP); Tomokazu Saruhashi, Yokosuka (JP); Junichi Miyazaki, Yokosuka (JP); Ikuo Sawada, Yokosuka (JP); Takazo Shibuya, Yokosuka (JP); Shinsuke Kawaguchi, Yokosuka (JP); Junichiro Ishibashi, Yokosuka (JP); Tatsuo Nozaki, Yokosuka (JP); Teruhiko Kashiwabara, Yokosuka (JP); Kentaro Nakamura, Yokosuka (JP); Katsuhiko Suzuki, Yokosuka (JP)
(73) Assignee: Japan Agency for Marine-Earth Science and Technology, Kanagawa (JP)

( * ) Notice: Subject to any disclaimer, the term of this patent is extended or adjusted under 35 U.S.C. 154(b) by 0 days.
(21) Appl. No.: 14/377,369
(22) PCT Filed: Feb. 8, 2013
(86) PCT No.: PCT/JP2013/053093
§ 371 (c)(1),
(2) Date: Aug. 7, 2014
(87) PCT Pub. No.: WO2013/118876
PCT Pub. Date: Aug. 15, 2013
(65) Prior Publication Data
US 2015/0361768 A1 Dec. 17, 2015
(30) Foreign Application Priority Data
Feb. 9, 2012 (JP) ..... 2012-026705
(51) Int. Cl.
*E21B 43/01* (2006.01)
*E21C 50/00* (2006.01)
(Continued)
(52) U.S. Cl.
CPC . *E21B 43/01* (2013.01); *E21B 7/12* (2013.01); *E21B 33/035* (2013.01); *E21B 33/076* (2013.01); *E21B 43/36* (2013.01); *E21C 50/00* (2013.01)
(58) Field of Classification Search
CPC ..... E21C 50/00; E21C 41/00; E21B 43/01; E21B 43/0122; E21B 43/28; E21B 43/16; E21B 43/36; B09C 1/002; B65D 88/78; C25C 1/20; E02F 3/9262; E02F 3/9281
See application file for complete search history.

(56) References Cited

U.S. PATENT DOCUMENTS 532,183 A * 1/1895 Pike ..... E02F 3/9262 209/454

(Continued)

FOREIGN PATENT DOCUMENTS

JP S58-113329 A 7/1983
JP S58-146695 A 9/1983

(Continued)

OTHER PUBLICATIONS

"The Status of JOGMEC's Efforts for the Development of Ocean Floor Hydrothermal Mineral Deposits and the International Status"; Nov. 2011; pp. 293-294; JOGMEC (Japan Oil, Gas and metals National Corporation) Deep-sea Exploration Division, Metals Mining Technology Department ; with English language partial translation.

(Continued)

*Primary Examiner* — James G Sayre
(74) *Attorney, Agent, or Firm* — Studebaker & Brackett PC

(57) ABSTRACT

A recovery method for recovering mineral resources from a hydrothermal fluid reservoir present beneath the ocean floor includes the steps of: (A) providing a hydrothermal fluid well by drilling a hole reaching a hydrothermal fluid reservoir from an ocean floor surface via a guide base on the ocean floor surface, and then installing a casing in the drilled hole via the guide base; (B) precipitating minerals on a mineral-culturing device by installing the mineral-culturing device on the base guide so as to cover a well head of the hydrothermal fluid well, and bringing hot water ejecting from the well head into contact with sea water on the mineral-culturing device; and (C) recovering minerals precipitated on the mineral-culturing device together with the mineral-culturing device.

15 Claims, 3 Drawing Sheets

(51) Int. Cl.

| | |
|---|---|
| ***E21B 7/12*** | (2006.01) |
| ***E21B 33/076*** | (2006.01) |
| ***E21B 33/035*** | (2006.01) |
| ***E21B 43/36*** | (2006.01) |

(56) References Cited

U.S. PATENT DOCUMENTS

| | | | | |
|---|---|---|---|---|
| 2,144,743 | A * | 1/1939 | Schulz | E21C 50/00 299/8 |
| 3,474,015 | A * | 10/1969 | Norris | C25C 1/20 205/747 |
| 3,868,312 | A | 2/1975 | Wanzenberg et al. | |
| 4,533,526 | A | 8/1985 | Delacour et al. | |
| 4,619,762 | A * | 10/1986 | Delacour | E21B 43/01 210/170.11 |
| 5,044,440 | A | 9/1991 | Stinessen et al. | |
| 6,245,955 | B1 | 6/2001 | Smith | |
| 2009/0013690 | A1 | 1/2009 | Marshall | |

FOREIGN PATENT DOCUMENTS

| | | | |
|---|---|---|---|
| JP | S59-102079 | A | 6/1984 |
| JP | H05-256082 | A | 10/1993 |
| JP | 2010-534777 | A | 11/2010 |
| JP | 2011-157795 | A | 8/2011 |

OTHER PUBLICATIONS

International Search Report; PCT/JP2013/053093; May 7, 2013.

Notification of Concerning Transmittal of Translation of the International Preliminary Report on Patentability and Translation of Written Opinion of the International Searching Authority; PCT/JP2013/053093; issued on Aug. 21, 2014.

The extended European search report issued by the European Patent Office on Nov. 16, 2015, which corresponds to European Patent Application No. 13746102.6-1610 and is related to U.S. Appl. No. 14/377,369.

An Office Action issued by the Japanese Patent Office on Oct. 6, 2015, which corresponds to Japanese Patent Application No. 2012-026705 and is related to U.S. Appl. No. 14/377,369.

A Notice of Allowance issued by the Japanese Patent Office on Jan. 5, 2016, which corresponds to Japanese Patent Application No. 2012-026705 and is related to U.S. Appl. No. 14/377,369.

* cited by examiner

METHOD AND SYSTEM FOR RECOVERING OCEAN FLOOR HYDROTHERMAL MINERAL RESOURCES

TECHNICAL FIELD

The present invention relates to a method and a system for recovering mineral resources from a hydrothermal fluid reservoir present beneath the ocean floor.

BACKGROUND ART

Ever since the end of the war, based on the realization that Japan is a country lacking resources such as metallic minerals, Japan has developed its economy by importing necessary minerals and the like. However, for the past several years, events that pose an obstacle to economic development such as the output limitation imposed by mineral-producing countries and a steep rise of prices have occurred. Against such a background, ocean floor resources in the seas close to Japan having the sixth largest exclusive economic zone (EEZ) in the world and 50 or more hydrothermal activity areas that serve as mineral sources are attracting even more attention.

There has been a basic scientific achievement saying that ocean floor resources including ocean floor hydrothermal minerals are rich with rare metal elements or rare earth elements. Based on the above-described achievement, a national strategy to estimate the reservoir of domestic ocean floor resources is becoming more important. However, in actuality, there are extremely huge problems with the technological development, profitability, and environmental impact assessment in steps for developing an ocean floor hydrothermal activity area from which ocean floor hydrothermal minerals are produced as a mineral deposit, mining resources, and putting the resources into practical use. As a result, there are only a few venture companies that are actually making any effort to recover resources from the ocean floor.

For the recovery of resources from the ocean floor, a series of operation steps such as the disposition of a special heavy machine on the ocean floor, the mining operation using the above-described heavy machine, and the transportation of rocks and/or sediment containing minerals to above the sea are assumed (refer to Non-Patent Literature 1). Studies are also underway regarding a method for extracting ocean floor minerals by sending hot water ejecting from the ocean floor to a mother ship on the sea using a pipe (refer to Patent Literature 1 and 2).

CITATION LIST

Patent Literature

[Patent Literature 1] Japanese Unexamined Patent Application Publication No. 5-256082

[Patent Literature 2] PCT Japanese Translation Patent Publication No. 2010-534777

Non Patent Literature

[Non-Patent Literature 1] Japan Oil, Gas and Metals National Corporation "The status of JOGMEC's efforts for the development of ocean floor hydrothermal mineral deposits and the international status", metallic resource report, [online], November 2011, [searched on Feb. 7, 2012], Internet, pages 293 to 294
<URL:http://mric.jogmec.go.jp/public/kogyojoho/2011-11/MR v41n4-01.pdf>

SUMMARY OF INVENTION

Technical Problem

However, it is anticipated that the recovery of resources using a heavy machine, which is described in Non-Patent Literature 1, may have a significant impact on the ocean floor and undersea environments due to the mining operation on the ocean floor. In addition, the step for recovering mineral resources from a hydrothermal area on the deep ocean floor that is, for example, 200 meters deep or more is still very risky in putting the method into practical use. Meanwhile, in the extracting methods described in Patent Literature 1 and 2, it is necessary to maintain the mother ship for recovering and treating hot water tied up on the sea, which makes the methods unsuitable for the continuous recovery of ocean floor mineral resources.

It has been clarified that a hydrothermal fluid reservoir present beneath the ocean floor in a deep sea hydrothermal activity area is rich with minerals containing a greater amount of rare earth elements or rare metal elements that are extremely important to industries. The invention is useful for continuously recovering mineral resources from a hydrothermal fluid reservoir, and an object of the invention is to provide a recovery method and a recovery system having a sufficiently decreased impact on the ocean floor and undersea environments.

Solution to Problem

The present inventors completed an innovative method and an innovative system for recovering ocean floor hydrothermal mineral resources that are significantly different from those of the related art as described below.

That is, a recovery method according to the invention is a method for recovering mineral resources from a hydrothermal fluid reservoir present beneath the ocean floor, including the steps of:

(A) providing a hydrothermal fluid well by drilling a hole reaching a hydrothermal fluid reservoir from an ocean floor surface via a guide base on the ocean floor surface, and then installing a casing in the drilled hole via the guide base;

(B) precipitating minerals on the mineral-culturing device by installing a mineral-culturing device on the base guide so as to cover a well head of the hydrothermal fluid well, and bringing hot water ejecting from the well head into contact with sea water on the mineral-culturing device; and (C) recovering minerals precipitated on the mineral-culturing device together with the mineral-culturing device.

In the recovery method, a hydrothermal fluid well (artificial hydrothermal vent) through which the hot water from the hydrothermal fluid reservoir present beneath the ocean floor directly ejects on the ocean floor is installed via the guide base. The hydrothermal fluid well and the guide base can be installed using, for example, the deep sea drilling vessel 'CHIKYU' operated by Japan Agency for Marine-Earth Science and Technology. When the mineral-culturing device is installed undersea so as to cover the well head of the hydrothermal fluid well, hot water containing a great amount of dissolved minerals comes into contact with the mineral-culturing device, and is mixed with the sea water having a low temperature (for example, 1° C. to 4° C.), thereby being rapidly cooled. Then, minerals (for example, black ores and metal sulfides) are precipitated on the mineral-culturing device. In addition, the minerals are grown on the mineral-culturing device over a certain period of time (for example, approximately one year), and then the minerals are recovered together with the mineral-culturing device. It can be said that the invention is a technique regarding not "the development of resource mineral deposits" that is dependent on 'inheritance' produced by the past earth activities and biological activities but "resource cultivation" that is a new creation and extraction of resources since, in the invention, mineral resources are grown on the mineral-cultivating device.

According to the invention in which the hydrothermal fluid well is used, it is possible to suppress the impact on the ocean floor and undersea environments to an extremely small extent compared with the method in which a heavy machine is used, and it is also possible to recover mineral resources from a hydrothermal area on the deep ocean floor that is, for example, 200 meters deep or more. Furthermore, since hot water continuously ejects from the hydrothermal fluid well as long as the hydrothermal activity continues, according to the invention, it is possible to continuously recover mineral resources from a hydrothermal fluid reservoir beneath the ocean floor.

The above-described recovery method preferably further includes the steps of: (D) after the recovery of the minerals and the mineral-culturing device, precipitating minerals on a mineral-culturing device by installing a new mineral-culturing device on the guide base so as to cover the well head of the hydrothermal fluid well, and bringing hot water ejecting from the well head into contact with sea water on the mineral-culturing device; and (E) recovering minerals precipitated on the mineral-culturing device together with the mineral-culturing device. Thus, it is possible to newly create and extract resources, and to newly create resources again. A series of operations comprising the step (D) and the step (E) is repeatedly carried out, for example, every year. To facilitate the exchange operation of the mineral-cultivating devices, the mineral-cultivating device is preferably detachable with respect to the guide base.

In the invention, as the mineral-cultivating device, it is possible to employ a device having a structure capable of cooling hot water from beneath the ocean floor, mixing the hot water and sea water, and holding the precipitated minerals. The mineral-cultivating device preferably includes a carrier, and more specifically, it is possible to employ a mineral-cultivating device including a lattice-shaped container and a carrier housed in the container. Meanwhile, the carrier is preferably made of a porous material, and examples of the porous material include porous ceramics, pumice, and the like. The mineral-cultivating device preferably includes a top surface extending in the horizontal direction from the viewpoint of preferably growing minerals on the top surface.

In a case in which a plurality of hydrothermal fluid wells are provided, it is possible to install the mineral-cultivating devices so as to cover individual well heads, precipitate minerals on the respective mineral-cultivating devices, then, recover the multiple mineral-cultivating devices using a vessel, and install new mineral-cultivating devices so as to cover individual well heads.

A recovery system according to the invention is a system for recovering mineral resources from a hydrothermal fluid reservoir present beneath an ocean floor, and includes a hydrothermal fluid well having a drilled hole reaching the hydrothermal fluid reservoir from an ocean floor surface and a casing installed in the drilled hole via a guide base on the ocean floor surface; and a mineral-cultivating device installed so as to cover a well head of the hydrothermal fluid well wherein hot water ejecting from the well head comes into contact with the mineral-cultivating device.

The guide base preferably includes legs having an adjustable length. The employment of the above-described configuration enables the appropriate installment of the guide base on the ocean floor surface even when the ocean floor surface is inclined or uneven.

Advantageous Effects of Invention

According to the invention, there are provided a method and a system that have a sufficiently decreased impact on the ocean floor and undersea environments, and are useful for continuously recovering mineral resources from a hydrothermal fluid reservoir present beneath the ocean floor.

DESCRIPTION OF EMBODIMENTS

Hereinafter, a preferred embodiment of the invention will be described with reference to the accompanying drawings. Similar or equivalent components will be given similar reference signs, and duplicate description will not be made.

<Ocean Floor Hydrothermal Mineral Resource-Recovering System>

Figure 1:
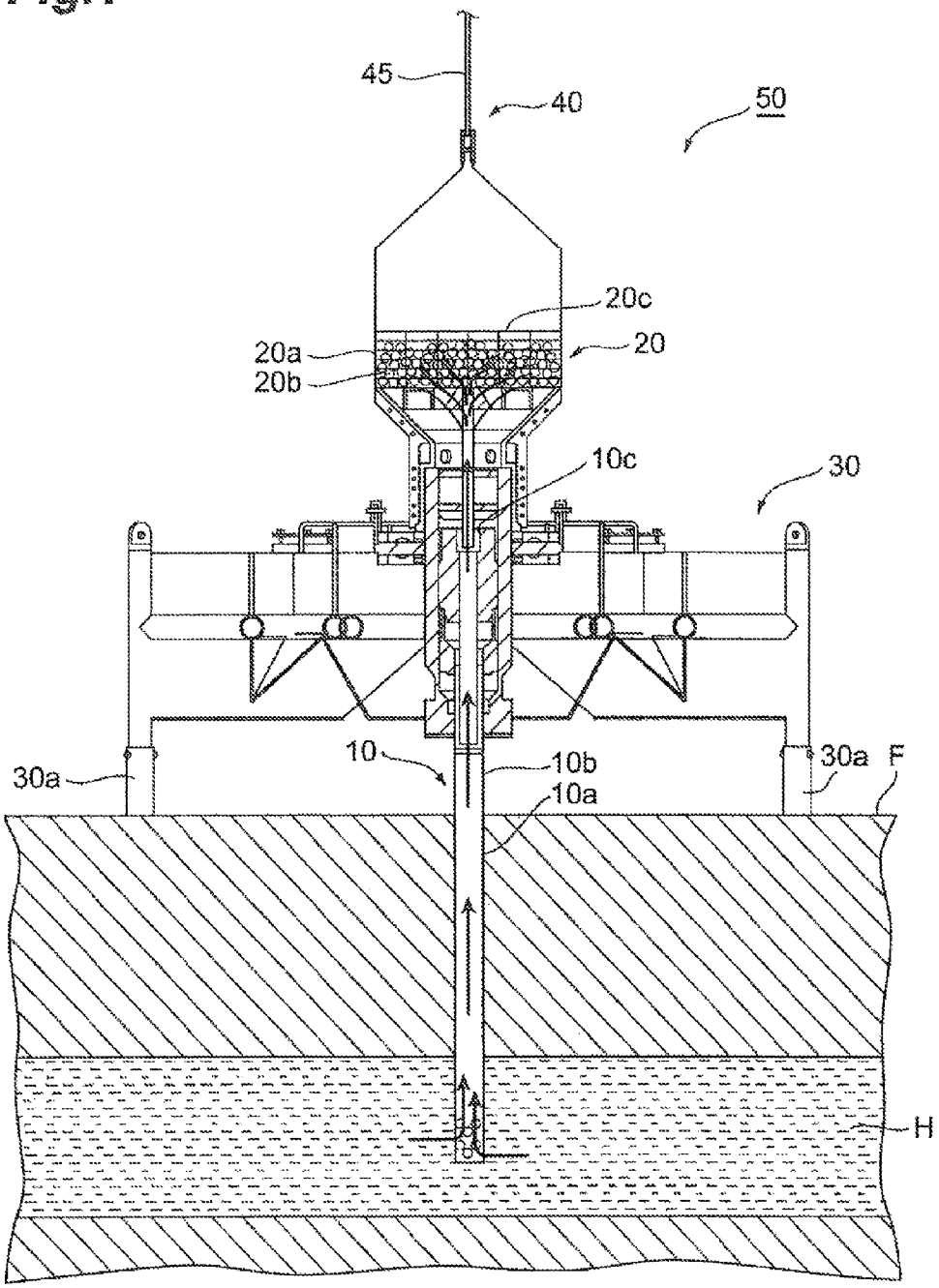
FIG. 1 is a cross-sectional view illustrating an embodiment of a recovery system according to the invention.

An embodiment of an ocean floor hydrothermal mineral resource-recovering system will be described in detail. A recovery system 50 illustrated in FIG. 1 includes a hydrothermal fluid well 10 having a drilled hole 10*a* reaching a hydrothermal fluid reservoir H from an ocean floor surface F and a casing 10*b* installed in the drilled hole 10*a*, a mineral-cultivating device 20 which is installed so as to cover a well head 10*c* of the hydrothermal fluid well 10 and with which hot water ejecting from the well head 10*c* comes into contact, a guide base 30 supporting the mineral-cultivating device 20, and a lifting system 40 used during the recovery of the mineral-cultivating device 20.

The hydrothermal fluid well 10 reaches the hydrothermal fluid reservoir H beneath the ocean floor from the ocean floor surface F. The hydrothermal fluid well 10 can be installed using, for example, the deep sea drilling vessel 'CHIKYU' operated by Japan Agency for Marine-Earth Science and Technology. The depth of the hydrothermal fluid well 10 is dependent on the location of the hydrothermal fluid reservoir H, the hardness of rocks, the depth of the sea, and the like, and can be set in a range of 30 m to 1000 m from the ocean floor surface F.

Figure 2:
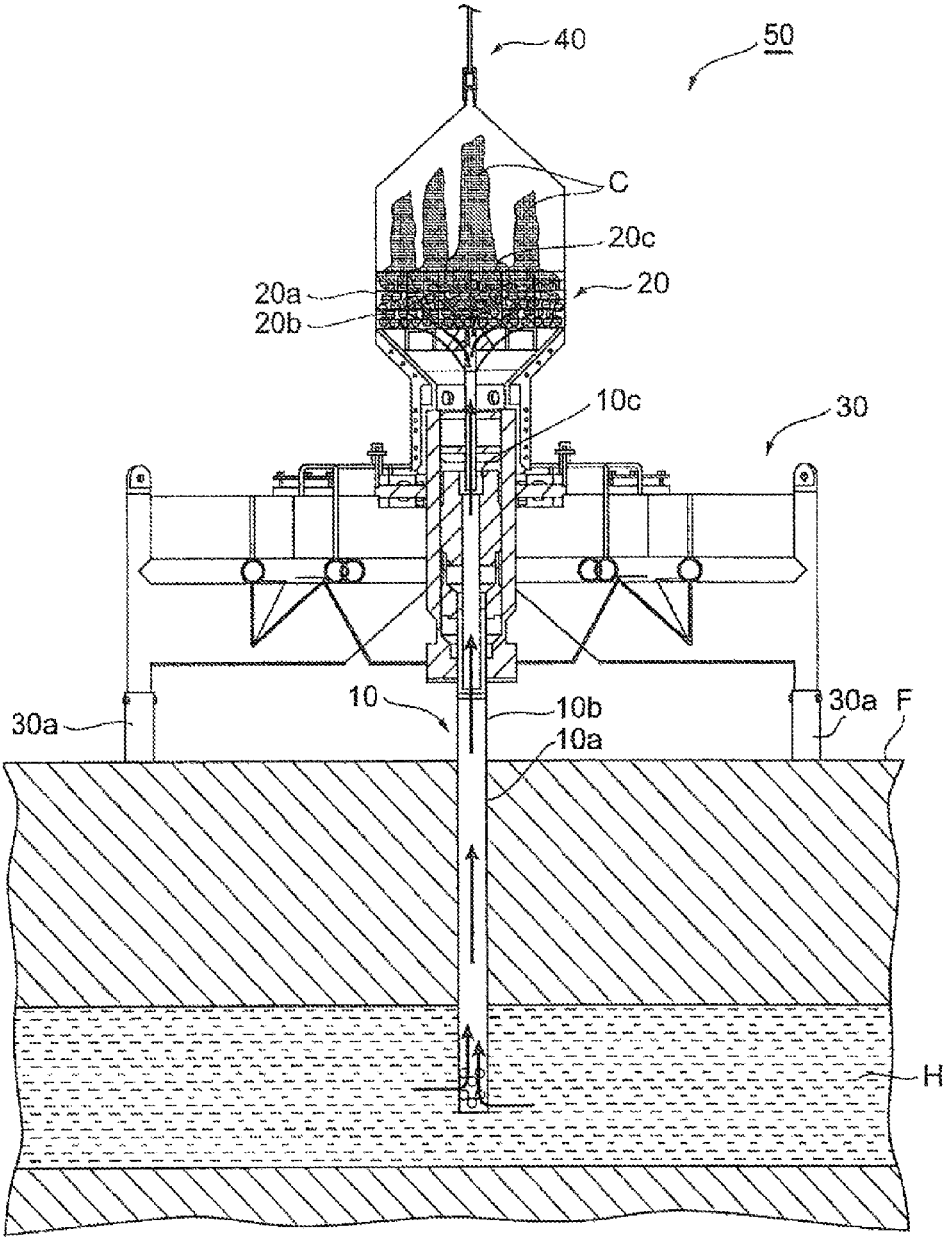
FIG. 2 is a view illustrating a state in which black ore is precipitated and grows on a mineral-cultivating device that is a part of a system according to the invention.

The mineral-cultivating device 20 is a device for precipitating minerals by bringing hot water ejecting from the well head 10*c* into contact with the mineral-cultivating device. The mineral-cultivating device 20 is made up of a lattice-shaped metal container 20*a* and a carrier 20*b* made of a porous material such as pumice or a porous ceramic loaded into the container 20*a*. Meanwhile, the mineral-cultivating device 20 is not limited to the above-described configuration, and may have a structure in which the carriers are overlaid in a net shape or a honeycomb structure so that the flowing area of hot water flowing upward from beneath the ocean floor is widened, the cooling of the hot water and the mixing of the hot water and sea water are accelerated, and a great liquid-solid contact surface area is given. The employment of the above-described mineral-cultivating device accelerates the deposition of minerals on the mineral-cultivating device. FIG. 2 is a view illustrating a state in which minerals grow on the mineral-cultivating device 20 so as to form a plurality of chimneys C. The mineral-cultivating device 20 preferably has a top surface 20*c* extending in the horizontal direction from the viewpoint of sufficiently growing the chimneys C upward.

Figure 3:
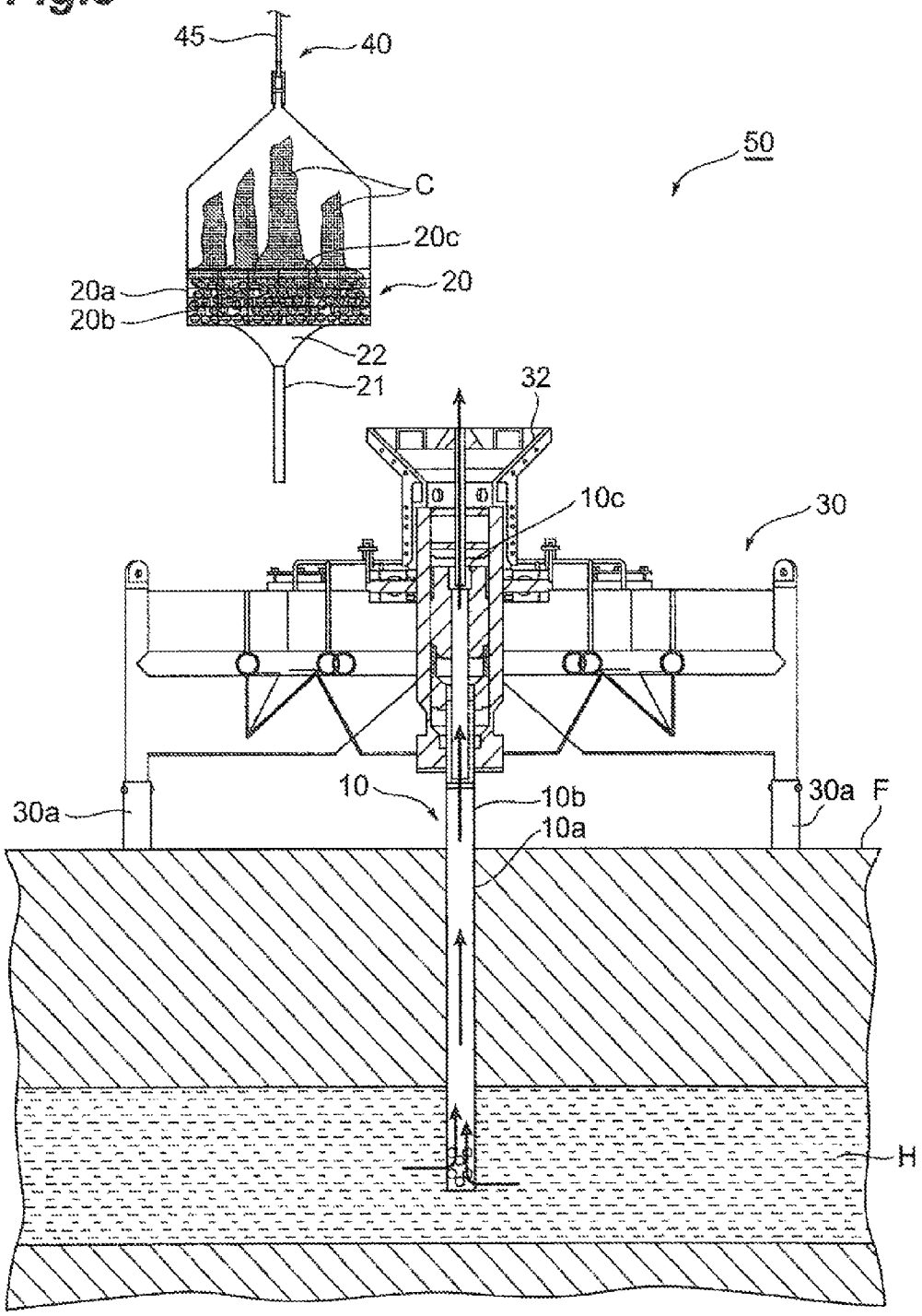
FIG. 3 is a view illustrating an appearance in which the mineral-cultivating device is detached from a guide base, and is recovered.

The mineral-cultivating device 20 is preferably provided so as to be detachable with respect to the guide base 30 as illustrated in FIG. 3. The mineral-cultivating device 20 includes a pipe 21 into which a part of the casing 10*b* is inserted when the mineral-cultivating device 20 is disposed so as to cover the well head 10*c*, and a diameter-increasing section 22 coupling the pipe 21 and the mineral-cultivating device 20. Hot water from the casing 10*b* flows into the mineral-cultivating device 20 through the pipe 21 and the diameter-increasing section 22. The hot water containing minerals comes into contact with the mineral-cultivating device 20, is mixed with sea water, and cooled, whereby minerals are precipitated on the mineral-cultivating device 20.

The guide base 30 is provided so that a drill bit and a drilling pipe can be vertically inserted into a drilling vessel such as 'CHIKYU' during drilling, and furthermore, is installed on the ocean floor surface F to insert and fix the casing pipe 10*b* into the drilled hole drilled using the drill bit. After the drilling and the insertion of the casing pipe, the mineral-cultivating device 20 is installed on the guide base 30. The guide base 30 includes three legs 30*a* having an adjustable length. The adjustment of the lengths of the legs 30*a* enables the drill bit and the drilling pipe to be inserted into the ocean floor surface F even when the surface is inclined or uneven, and furthermore, enables the casing pipe to be inserted into beneath the ocean floor vertically with respect to the drilling vessel. Corresponding to the diameter-increasing section 22 of the mineral-cultivating device 20, the guide base 30 includes a diameter-increasing section 32 on the upper part. The guide base 30 may have a locking mechanism with respect to the mineral-cultivating device 20 so as to prevent the mineral-cultivating device 20 from being removed due to an impact, a tide, and the like.

The lifting system 40 is to be used when the mineral-cultivating device 20 is recovered. As illustrated in FIG. 3, the lifting system 40 has an arrangement so that the mineral-cultivating device 20 can be recovered to a vessel using a wire 45.

<Ocean Floor Hydrothermal Mineral Resource-Recovering Method>

Next, a method for recovering mineral resources using the recovery system 50 will be described. A method according to the embodiment includes the following steps:

(A) providing the hydrothermal fluid well 10 by drilling the hole 10*a* reaching the hydrothermal fluid reservoir H from the ocean floor surface F via the guide base 30 on the ocean floor surface F, and then installing the casing 10*b* in the drilled hole 10*a* via the guide base 30;

(B) precipitating minerals on the mineral-cultivating device 20 by installing the mineral-cultivating device 20 on the guide base 30 so as to cover the well head 10*c* of the hydrothermal fluid well 10, and bringing hot water (refer to arrows in the drawing) ejecting from the well head 10*c* into contact with sea water on the mineral-cultivating device 20; and (C) recovering minerals precipitated on the mineral-cultivating device 20 together with the mineral-cultivating device 20 (refer to FIG. 3).

When the mineral-cultivating device 20 is installed undersea so as to cover the well head 10*c* of the hydrothermal fluid well 10, hot water containing minerals comes into contact with the mineral-cultivating device 20, is mixed with the sea water, and is cooled, whereby minerals are precipitated on the mineral-cultivating device 20. Depending on components contained in the hot water, the minerals being precipitated are, for example, black ores, pyrites, and the like that are rich with rare metal elements or rare earth elements. After the minerals are grown on the mineral-cultivating device 20 over a certain period of time (for example, approximately one month to one year), the minerals are recovered together with the mineral-cultivating device 20.

According to the above-described recovery method, it is possible to suppress the impact on the ocean floor and undersea environments to an extremely small extent compared with a method in which a heavy device is used, and it is also possible to recover mineral resources from a hydrothermal area on the deep ocean floor that is, for example, 200 meters deep or more. Furthermore, since hot water continuously ejects from the hydrothermal fluid well 10 as long as the hydrothermal activity continues, it is possible to continuously recover mineral resources from the hydrothermal fluid reservoir H.

The above-described recovery method may further include the following steps:

(D) after the recovery of the minerals and the mineral-cultivating device 20, precipitating minerals on the a mineral-cultivating device by installing a new mineral-cultivating device on the guide base 30 so as to cover the well head 10*c* of the hydrothermal fluid well 10, and bringing hot water ejecting from the well head 10*c* into contact with sea water on the mineral-cultivating device; and (E) recovering minerals precipitated on the mineral-cultivating device together with the mineral-cultivating device.

A series of operations comprising the step (D) and the step (E) is repeatedly carried out, for example, every year. To facilitate the exchange operation of the mineral-cultivating devices 20, the mineral-cultivating device 20 is preferably detachable with respect to the guide base 30. When the above-described operation is carried out, it is possible to newly create and extract resources, and to newly create resources again. Meanwhile, in a case in which a plurality of the hydrothermal fluid wells 10 are provided, it is possible to install the mineral-cultivating devices 20 so as to cover individual well heads 10*c*, precipitate minerals on the respective mineral-cultivating devices 20, then, recover the multiple mineral-cultivating devices 20 using a vessel, and install new mineral-cultivating devices 20 so as to cover individual well heads.

According to the recovery method and the recovery system of the embodiment, it is possible to sufficiently decrease the impact on the ocean floor and undersea environments. In addition, according to the embodiment, since it is possible to continuously recover mineral resources from the hydrothermal fluid reservoir H beneath the ocean floor, it is not essentially required to maintain a recovery vessel tied up on the sea while minerals are generated.

EXAMPLES

The inventors extracted a chimney formed in the vicinity of a natural hydrothermal vent (natural hydrothermal vent chimney) and a chimney formed in the vicinity of a hydrothermal fluid well artificially provided through a drilling operation (artificial hydrothermal vent chimney) from the ocean floor in the Okinawa Trough, and compared the elemental compositions of both chimneys. The results are as described in Table 1. In addition, according to the inventors' continuous observation of the Okinawa ocean floor, it is clarified that the chimney formed in the artificial hydrothermal vent grows at a significantly rapid rate compared with the chimney formed in the natural hydrothermal vent.

TABLE 1

| | Natural hydrothermal hole vent chimney (ppm) | Artificial hydrothermal hole vent chimney (ppm) |
|---|---|---|
| Barium | 268000 | 450 |
| Iron | 65000 | 84000 |
| Zinc | 200000 | 355000 |
| Lead | 700 | 74000 |
| Copper | 24000 | 70000 |
| Calcium | 200000 | 2400 |
| Gold | 0.2 | 1.4 |
| Silver | 100 | 800 |
| Antimony | 30 | 250 |

INDUSTRIAL APPLICABILITY

According to the invention, it is possible to sufficiently decrease the impact on the ocean floor and undersea environments, and it becomes possible to continuously recover mineral resources from the hydrothermal fluid reservoir present beneath the ocean floor.

REFERENCE SIGNS LIST

10: hydrothermal fluid well, 10*a*: drilled hole, 10*b*: casing, 10*c*: well head, 20: mineral-cultivating device, 20*a*: container, 20*b*: carrier, 30: guide BASE, 40: lifting system, 50: recovery system, C: chimney, F: ocean floor surface, H: hydrothermal fluid reservoir

The invention claimed is:

1. A recovery method for recovering mineral resources from a hydrothermal fluid reservoir present beneath the ocean floor, the recovery method comprising the steps of:

(A) providing a hydrothermal fluid well by drilling a hole reaching a hydrothermal fluid reservoir from an ocean floor surface via a guide base on the ocean floor surface, and then installing a casing in the drilled hole via the guide base;

(B) precipitating minerals on a mineral-culturing device by installing the mineral-culturing device on the base guide so as to cover a well head of the hydrothermal fluid well, and bringing hot water ejecting from the well head into contact with sea water on the mineral-culturing device; and (C) recovering minerals precipitated on the mineral-culturing device together with the mineral-culturing device.

2. The recovery method according to claim 1, further comprising the steps of:

(D) after the recovery of the minerals and the mineral-culturing device, precipitating minerals on a mineral-culturing device by installing a new mineral-culturing device on the guide base so as to cover the well head of the hydrothermal fluid well, and bringing hot water ejecting from the well head into contact with sea water on the mineral-culturing device; and (E) recovering minerals precipitated on the mineral-culturing device together with the mineral-culturing device.

3. The recovery method according to claim 2, wherein a series of operations comprising the step (D) and the step (E) is repeatedly carried out.

4. The recovery method according to claim 1, wherein the mineral-culturing device is detachable with respect to the guide base.

5. The recovery method according to claim 1, wherein the mineral-culturing device has a structure capable of cooling the hot water from beneath the ocean floor, mixing the hot water and sea water, and holding the precipitated minerals.

6. The recovery method according to claim 1, wherein the mineral-culturing device includes a carrier.

7. The recovery method according to claim 1, wherein the mineral-culturing device includes a top surface extending in the horizontal direction.

8. The recovery method according to claim 1, wherein a plurality of the hydrothermal fluid wells are provided, the mineral-culturing devices are installed so as to cover individual well heads, minerals are precipitated on the respective mineral-culturing devices, then, the multiple mineral-culturing devices are recovered using a vessel, and new mineral-culturing devices are installed so as to cover individual well heads.

9. A recovery system for recovering mineral resources from a hydrothermal fluid reservoir present beneath an ocean floor, the recovery system comprising:

a hydrothermal fluid well having a drilled hole reaching the hydrothermal fluid reservoir from an ocean floor surface and a casing installed in the drilled hole via a guide base on the ocean floor surface; and a mineral-culturing device installed so as to cover a well head of the hydrothermal fluid well wherein hot water which ejects from the well head comes into contact with the mineral-culturing device.

10. The recovery system according to claim 9, wherein the mineral-culturing device is detachable with respect to the guide base.

11. The recovery system according to claim 9, wherein the mineral-culturing device has a structure capable of cooling the hot water from beneath the ocean floor, mixing the hot water and sea water, and holding the precipitated minerals.

12. The recovery system according claim 9, wherein the mineral-culturing device includes a carrier.

13. The recovery system according to claim 9, wherein the mineral-culturing device includes a top surface extending in the horizontal direction.

14. The recovery system according to claim 9, wherein the mineral-culturing device is made up of a lattice-shaped container and a carrier housed in the container.

15. The recovery system according to claim 9, wherein the guide base includes legs having an adjustable length.

* * * * *